US005644792A

United States Patent [19]

Tishler et al.

[11] Patent Number: 5,644,792

[45] Date of Patent: Jul. 8, 1997

[54] LOAD-BEARING, PERSONALLY WORN SYSTEM FOR SECURITY AND COMBAT UNITS

[75] Inventors: Dror Tishler; Nitzan Kimchi, both of Jerusalem, Israel

[73] Assignee: Kata Professional L.T.D., Jerusalem, Israel

[21] Appl. No.: 393,535

[22] Filed: Feb. 23, 1995

[51] Int. Cl.[6] ..... F41H 1/02

[52] U.S. Cl. ..... 2/2.5; 2/463; 2/465; 2/467

[58] Field of Search ..... 2/2.5, 102, 463, 2/465, 467

[56] References Cited

U.S. PATENT DOCUMENTS

| | | | |
|---|---|---|---|
| 1,739,112 | 12/1929 | Wisbrod | 2/2.5 |
| 2,052,684 | 9/1936 | Wisbrod | 2/2.5 |
| 3,843,969 | 10/1974 | George et al. | 2/2.5 |
| 3,873,998 | 4/1975 | Norris et al. | 2/2.5 |
| 4,413,357 | 11/1983 | Sacks | 2/2.5 |
| 4,497,069 | 2/1985 | Braunhut | 2/2.5 |
| 4,535,478 | 8/1985 | Zufle | 2/2.5 |
| 4,578,821 | 4/1986 | Zufle | 2/2.5 |
| 4,774,724 | 10/1988 | Sacks | 2/2.5 |
| 5,060,314 | 10/1991 | Lewis | 2/2.5 |
| 5,325,538 | 7/1994 | Schoenweiss et al. | 2/2.5 |

*Primary Examiner*—Paul C. Lewis

*Attorney, Agent, or Firm*—Baker & Botts, L.L.P.

[57] ABSTRACT

The invention provides a personally-worn system for security and combat units, comprising modular, interchangeable, load-bearing front and back panels having predesignated pouch arrangements integrally formed therewith, the front and back panels being interchangably secured to each other via interconnecting shoulder straps. The load-bearing panels are each further provided with interconnection means for optional releasable attachment of front or back body armour panels to an inner-facing surface thereof, and each of the body armour panels, when attached to the load-bearing panels, is secured to the body of the wearer by means of the respective load-bearing panel to which it is attached.

9 Claims, 3 Drawing Sheets

LOAD-BEARING, PERSONALLY WORN SYSTEM FOR SECURITY AND COMBAT UNITS

The present invention relates to a load-bearing, personally worn system for security and combat units. More particularly, the invention provides modular means for combining various military-type pouches securely on a wearer, provision being made for adding wearable armor to achieve the required degree of anti-ballistic protection.

Security and combat units, typically including anti-terror units and police and army units who are charged with carrying out certain high-risk operations, are usually specially equipped, the type of equipment provided varying in accordance with the mission to be performed. Such equipment falls into two categories: (a) anti-ballistic protection, the degree of protection being suited to the anticipated threat; and (b) pouches or straps for holding ammunition, hand weapons and accessories, grenades of various types, first-aid kits, communication means, tools, binoculars, a helmet, and whatever other items can be foreseen to be of utility in relation to said mission.

It will be readily understood that a modular system, allowing for a variety of final configurations, offers many advantages. There are different types of missions, for example, in a night-time assault, light weight which allows fast, quiet movement may be of primary importance. In a day-time mission against a force known to be armed with firearms, it may be more important to provide the combat unit with the maximum possible ballistic protection. The combat unit will comprise persons having different tasks, such as, e.g., command, communications, medic, combat; each of these different tasks will require a different configuration of equipment.

A known method of meeting these requirements is to provide a vest, either with or without an armored panel, to be worn by the user thereof. The outer surface of the vest has means for the removable attachment of equipment pouches. Such attachment means may comprise snaps, hook and loop (e.g. VELCRO™) strips, quarter-turn fasteners, etc. Under ordinary conditions, such fasteners have been found to be satisfactory. However, they have been known to fail under high stress, such as when the wearer pushes through dense bushes or narrow passages, crawls over rough ground, and so forth. The resultant loss of equipment may endanger the life of the wearer or even mandate the abortion of the mission, aside from the danger that the lost items may fall into the wrong hands. This problem may be solved by permanently attaching the pouches to the vest, for example, by sewing; however, the variability of configuration is thereby lost.

As is known, different degrees of ballistic protection are provided by armor panels of different thicknesses, materials, weights, and cost. Armor panels are graded in accordance with their ability to prevent penetration of bullets having a specified weight and velocity.

A mission in which close-range protection is required against high velocity fire will call for a greater degree of protection than will a situation in which only long-range fire or fragments are expected and the incoming bullet velocity is greatly reduced. Consequently, a specific vest provided with permanently built-in ballistic protection may be too heavy to use, unnecessarily expensive and unduly restrict the movement of the wearer; conversely, it may not provide the high degree of protection required for a specific mission.

It is therefore one of the objects of the present invention to obviate the disadvantages of the prior art load-carrying military vests, and to provide a vest which securely holds pouches, while allowing for modular variation of same.

The present invention achieves said objectives by providing a personally-worn system for security and combat units, comprising modular, interchangeable, load-bearing front and back panels having predesignated pouch arrangements integrally formed therewith, said front and back panels being interchangably secured to each other via interconnecting shoulder straps; said load-bearing panels being further provided with interconnection means for optional releasable attachment of front or back body armor panels to an inner-facing surface thereof; and wherein each of said body armor panels, when attached to said load-bearing panels, is secured to the body of the wearer by means of the respective load-bearing panel to which it is attached.

It will be understood that in the system of the present invention there will be provided a plurality of interchangeable, load-bearing front panels, each having its own integral, pre-designated pouch arrangement, and a plurality of interchangeable load-bearing back panels, each also having its own integral, pre-designated pouch arrangement, so that the user has a choice as to which of a full range of front panels and which of a full range of back panels he will interconnect via said shoulder straps to form his personally worn system.

Since in the present system the front and back panels have integrally formed pouches which are secured to the wearer with shoulder straps, and it is the armor panels which are attached thereto and may be readily removed and exchanged as desired, to suit the mission which they are to serve, rather than vice-versa as has been the practice to date, the system is much more versatile and secure.

In a most preferred embodiment of the present invention, there is provided a personally-worn system for security and combat units, wherein said each of said armor panels is provided with a front portion and a back portion, each of said portions having a top, a bottom, and two side edges, and wherein said front and back portions are connected to each other along three of said edges, to form a pocket between them in which one or more protective plates may be held, and wherein at least one of the connected edges of said armor panel is provided with a flap to which is attached a hook and loop (e.g., VELCRO™) fastening strip complementary to a matching strip provided adjacent to an edge of the outer-facing surface of the load-bearing panel to which it is attached, said flap of said armor panel being sized to be wrapped around said edge of said load-bearing panel, and to be secured thereto by means of said velcro-type fastening strips.

In another preferred embodiment of the present invention, instead of combining said load-bearing panels with front or back armor panels, said interconnection means are connected to padding panels for added comfort and insulation of the body from said load-bearing panels.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 illustrates a modular, load-bearing, personally worn system 10 for security and combat units.

Figure 1:
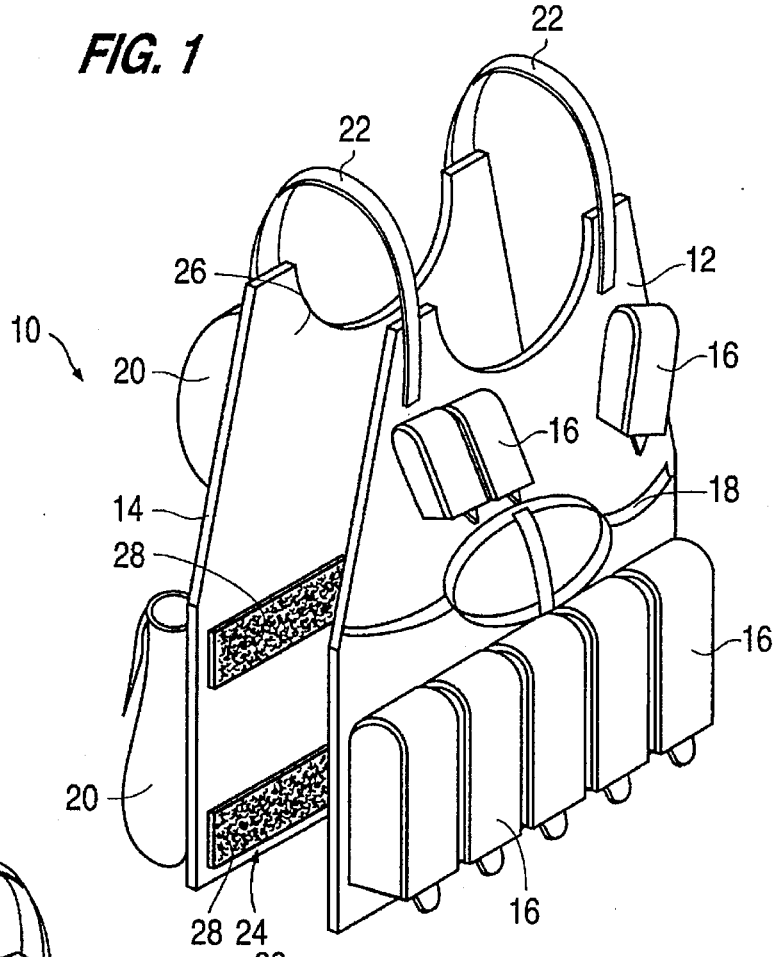
FIG. 1 is a perspective view of a preferred embodiment of the system according to the invention.

The main components of system 10 are a pair of modular, interchangable, load-bearing front and back panels 12, 14 which have predesignated pouch arrangements integrally formed therewith. Pouches 16 are attached to panels 12, 14 in a permanent manner by sewing, and cannot become inadvertently detached from the panels.

Typically, the front panel 12 has between 8 to 14 pouches 16, or strap holders 18, which cover the requirements of most missions. Pouches 16 on front panel 12 (shown empty) are designed primarily to hold ammunition magazines, but provision is also made for other items such as grenades, binoculars and hand weapons. The back panel 14 has a smaller number of larger pouches 20, arranged to hold items such as an axe, helmet, radio, first-aid kit, and possibly additional reserve ammunition magazines.

Front and back panels 12, 14 are interchangably secured to each other, via interconnecting adjustable shoulder straps 22. It will be understood that different load-bearing panels can be used in various pair combinations to meet almost any requirement, and said back, load-bearing panel can even preferably be formed with backpack-type large pouches 20 and suspension systems for more comfortable weight distribution of the load to be carried, wherein all of the load compartments are directly and indirectly dependent from the backpack-type system. In such a system, further supplementary padded shoulder straps and padded waist belts (not shown) can be included.

The load-bearing panels 12, 14 can be used, as shown in FIG. 1, without any armor, e.g., by interconnection with simple padding panels (not shown). However, both panels 12, 14 are provided with means 24 for releasable attachment of front and back body panels to each respective inner-facing surface 26 thereof, to be described further below with reference to FIG. 2. It will be evident that each body panel is securely attached to the wearer by means of its respective load-bearing panel 12, 14.

Figure 2:
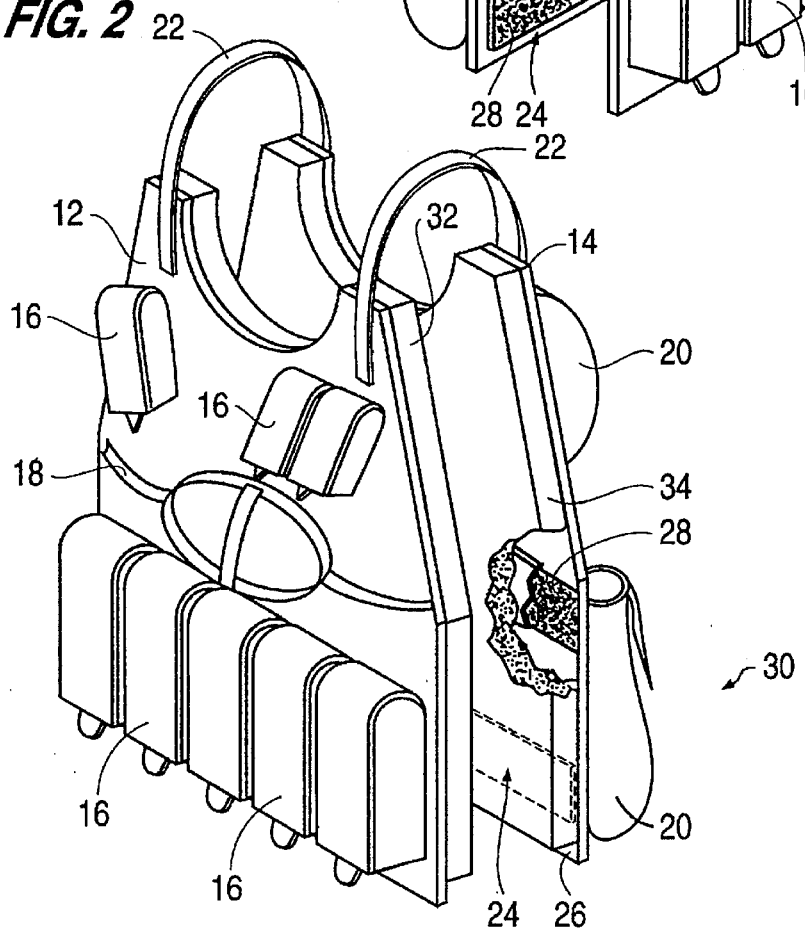
FIG. 2 is a perspective, partly fragmented view of an embodiment including armor panels.

FIG. 2 shows the connection means used to hold these panels in place, which means preferably include matching interlocking hook and loop (e.g., VELCRO™) fastening strips 28. These are provided along the inner-facing surface 26 of each load-bearing panel 12, 14 and along an outer-facing surface of each body armor panel to be attached thereto.

Referring now to FIG. 2, there is shown a modular, load-bearing, personally worn system 30, including front and back armor panels 32, 34, which are releasably attached to the respective inner surfaces 26 of the load-bearing front and back panels 12, 14.

As explained hereinabove, different degrees of ballistic protection are provided by armor panels made of different thicknesses, materials, weight and cost, each grade of armor being suited to provide ballistic protection of a specified degree. Armor panels 32, 34 are easily and quickly exchanged, each grade being geometrically similar to all other grades except for variations in thickness. The load-bearing panels easily accept even the thickest grade of armor.

Figure 3:
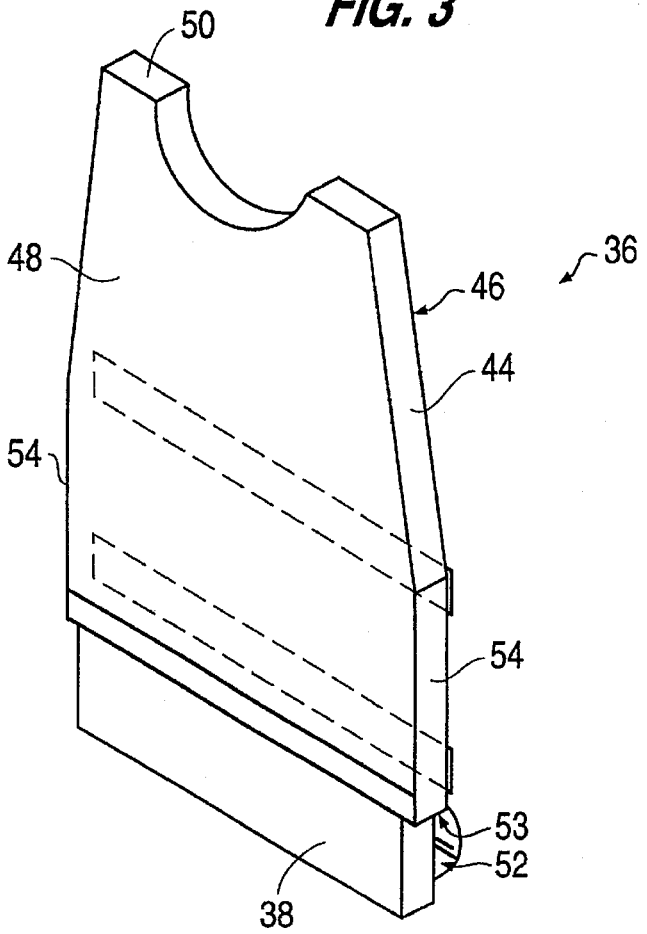
FIG. 3 is a perspective view of a detail of a system, showing an additional armor plate partly projecting outside the panel.

FIG. 3 shows a detail of a modular system 36, which is similar to that shown in FIG. 2, except that provision is made for the addition of further protective armor plates 38. By the addition thereof, the degree of protection provided by the front and back armor panels 32, 34 (shown in FIG. 2) can be boosted by at least one grade. Alternatively, sponge-like or other padding panels can be inserted instead of armor plates 38, to achieve a padded effect.

Front armor panel 44 is provided with front and back surfaces 46, 48, each of which has a top 50, a bottom 52 and two side edges 54. Surfaces 46, 48 are connected to each other along three of these edges to form a pocket 53 between them for containing one or more protective plates 38.

Figure 4:
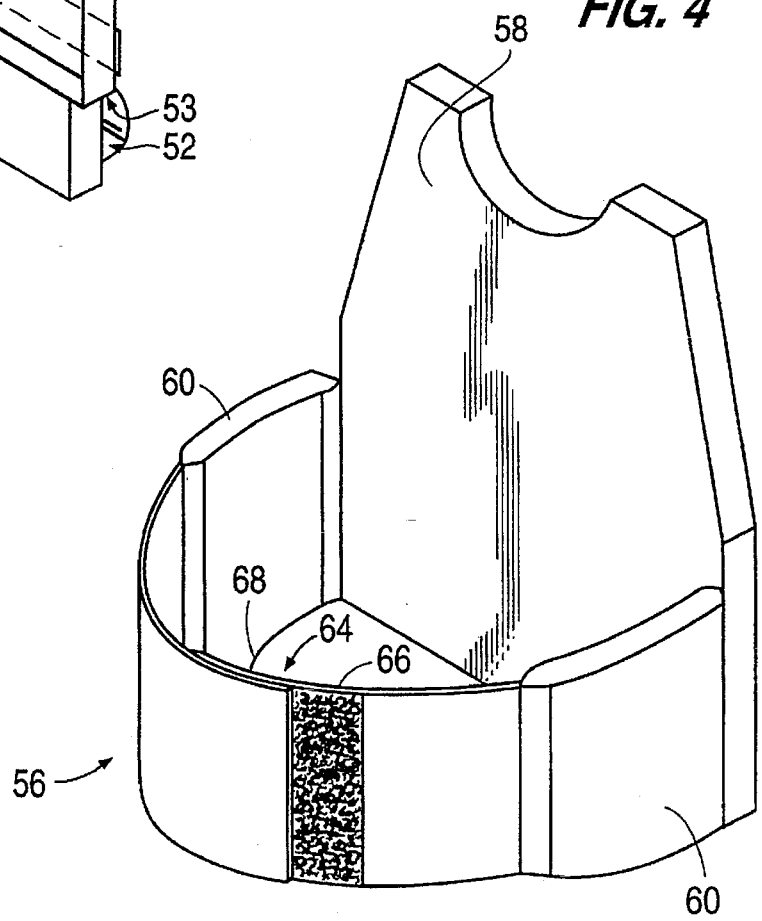
FIG. 4 is a perspective view of a detail of a system provided with side armor.

Seen in FIG. 4 is a part of a further system 56 for security and combat units, additionally providing side protection. The back armor panel 58 is provided with two integrally dependent side armor panels 60, sized to extend along the sides of the wearer of the system. It is provided with means for interconnection in front of the wearer, between the wearer's body and the front load-bearing panel 12 seen in FIG. 1, thereby not interfering with the pouches provided on the front panel and allowing easy access thereto. Interconnection means 64 shown comprises matching hook and loop (e.g., VELCRO™) strips 66, 68, one of strips 66 having sufficient width to allow for varying attachment positions to suit the body size of the wearer.

Figure 5:
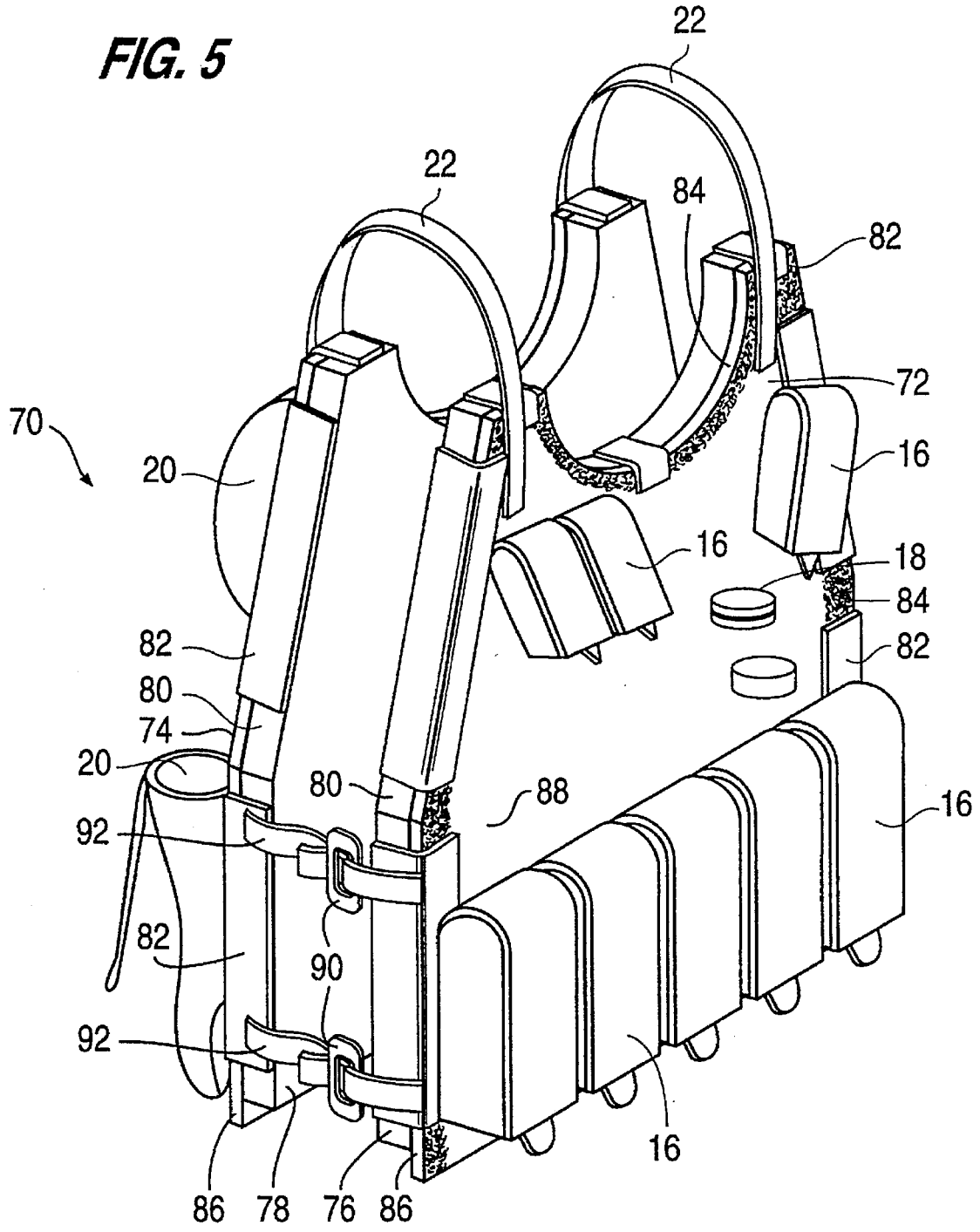
FIG. 5 is a perspective view of a system provided with edge flaps for additional security in attachment of the armor panels.

Referring now to FIG. 5, there is shown an embodiment of the system 70 wherein the load-bearing panels 72, 74 and armor panels 76, 78 are connected at their edges. The edges 80 of armor panels 76, 78 are provided with flaps 82, to which are attached hook and loop (e.g., VELCRO™) fastening strips, which are complemetary to matching strips 84 provided on adjacent edges 86 of outer-facing surface 88 of panel 72. The edge flaps 82 of armor panel 76 are sized to be wrapped around edge 86 and to be secured thereto by means of the hook and loop (e.g. VELCRO™) fasteners. Such an attachment has been found to remain secure against accidental detachment.

Further provided are interlocking buckles 90 and straps 92, for further securing the sides of load-bearing panels 72 and 74 to each other and to the body of the user.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A personally-worn system for security and combat units, comprising:

a plurality of modular, interchangeable, load-bearing front and back panels each having one of a plurality of differing predesignated pouch arrangements integrally formed therewith, said load-bearing panels being interchangeably secured to each other via interconnecting shoulder straps to form at least one garment having a load-bearing front panel and a load-bearing back panel; and a plurality of interchangeable front and back armor panels, wherein each of said load-bearing panels has an inner-facing surface provided with interconnection means for optional releasable attachment of one of said plurality of front and back armor panels thereto, and wherein each of said armor panels, when attached to one of said load-bearing panels, is secured to the body of the wearer by means of said one of said load-bearing panels.

2. The system according to claim 1, wherein said front armor panels and said back armor panels are interchangeable with one another.

3. The system according to claim 1, wherein said interconnection means includes matching, interlocking hook and loop fastening strips provided along said inner-facing surface of each load-bearing panel and along an outer-facing surface of said armor panel to be attached thereto.

4. The system according to claim 2, wherein each of said armor panels is provided with a front portion and a back portion, each of said portions having four edges including a top, a bottom, and two side edges, and wherein said front and back portions are fixedly connected to each other along three of said edges, and wherein the fourth of said edges are joined by a readily openable connection means to form a pocket between them in which one or more protective plates may be held and readily inserted and removed.

5. The system according to claim 4, wherein at least one of the fixedly connected edges of said armor panel is provided with a flap to which is attached a hook and loop fastening strip complementary to a matching hook and loop fastening strip provided on and adjacent to an edge of the outer-facing surface of the load-bearing panel to which said body armor panel is attached, said flap being sized to be wrapped around one of said edges of said load-bearing panel, and to be secured thereto by means of said hook and loop fastening strips.

6. The system according to claim 1, wherein at least one of said back armor panels is provided with two integrally dependent side armor panels sized to extend along the sides of a wearer's body, and provided with means for interconnection in front of the wearer, between the wearer's body and a front load-bearing panel to which it is attached.

7. A personally-worn system for security and combat units, wherein the system is adapted to incorporate at least one of a plurality of optional, releasably attachable, interchangeable front and back armor panels, the system comprising:

a plurality of modular, interchangeable, load-bearing front and back panels each having one of a plurality of differing predesignated pouch arrangements integrally formed therewith, said load-bearing panels being interchangeably secured to each other via interconnecting shoulder straps to form at least one garment having a load-bearing front panel and a load-bearing back panel;

said load-bearing panels each having an inner-facing surface provided with interconnection means adapted for optional releasable attachment of one of the plurality of armor panels thereto, and wherein each of the plurality of armor panels, when attached to one of said load-bearing panels, is secured to the body of the wearer by means of said one of said load-bearing panels.

8. A personally-worn system for security and combat units, comprising:

a plurality of modular, interchangeable, load-bearing front and back panels having predesignated pouch arrangements integrally formed therewith, said load-bearing panels being interchangeably secured to each other via interconnecting shoulder straps; and a plurality of interchangeable front and back armor panels, wherein at least one of said load-bearing panels has an inner-facing surface provided with a first interconnection means affixed thereto and at least one of said armor panels is provided with a second interconnection means affixed thereto, said first and second interconnection means cooperating to optionally and releasably secure said at least one armor panel to said at least one load-bearing panel so that said at least one armor panel is readily removable from said at least one load-bearing panel, and wherein said at least one armor panel, when attached to said at least one load-bearing panel, is secured to the body of the wearer by means of said at least one load-bearing panel.

9. A personally-worn system for security and combat units, comprising:

a plurality of modular, interchangeable, load-bearing front and back panels having predesignated pouch arrangements integrally formed therewith, said load-bearing panels being interchangeably secured to each other via interconnecting shoulder straps; and a plurality of interchangeable front and back armor panels, wherein each of said load-bearing panels has an inner-facing surface provided with interconnection means for optional releasable attachment of one of said plurality of front and back armor panels thereto, wherein each of said armor panels, when attached to one of said load-bearing panels, is secured to the body of the wearer by means of said one of said load-bearing panels, and wherein each of said armor panels is adapted to enclose therein a plurality of interchangeable armor plates.

* * * * *